US011626035B2

(12) United States Patent
Liebl et al.

(10) Patent No.: US 11,626,035 B2
(45) Date of Patent: Apr. 11, 2023

(54) LABELLING ARRANGEMENT FOR DEEP-FREEZE APPLICATIONS, SYSTEM AND METHOD FOR APPLYING A LABELLING ARRANGEMENT FOR DEEP-FREEZE APPLICATIONS

(71) Applicant: Schreiner Group GmbH & Co. KG, Oberschleissheim (DE)

(72) Inventors: Christian Liebl, Westbury, NY (US); Stefan Krauss, Munich (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 118 days.

(21) Appl. No.: 17/311,799

(22) PCT Filed: Dec. 11, 2019

(86) PCT No.: PCT/EP2019/084679
§ 371 (c)(1),
(2) Date: Jun. 8, 2021

(87) PCT Pub. No.: WO2020/120588
PCT Pub. Date: Jun. 18, 2020

(65) Prior Publication Data

US 2022/0036767 A1 Feb. 3, 2022

Related U.S. Application Data

(60) Provisional application No. 62/778,446, filed on Dec. 12, 2018.

(51) Int. Cl.

| | |
|---|---|
| ***G09F 3/10*** | (2006.01) |
| ***G09F 3/00*** | (2006.01) |
| *G09F 3/02* | (2006.01) |

(52) U.S. Cl.
CPC ..... *G09F 3/0291* (2013.01); *G09F 3/10* (2013.01); *G09F 2003/023* (2013.01)

(58) Field of Classification Search
CPC .... G09F 3/10; G09F 2003/023; G09F 3/0288; G09F 2003/0272; B65C 1/00; B65C 11/06
See application file for complete search history.

(56) References Cited

U.S. PATENT DOCUMENTS 3,904,806 A * 9/1975 Waggoner ..... D21H 19/22 428/511
4,247,563 A 1/1981 Sample
(Continued)

FOREIGN PATENT DOCUMENTS

CN 103843051 A 6/2014
CN 104394826 A 3/2015
(Continued)

OTHER PUBLICATIONS

International Search Report in PCT/EP2019/084679, dated Apr. 22, 2020.
(Continued)

*Primary Examiner* — Shin H Kim
(74) *Attorney, Agent, or Firm* — Collard & Roe, P.C.

(57) ABSTRACT

A labeling arrangement (1) for frozen applications comprises a top label (10) having an adhesive layer (12) having a predetermined freezing temperature below 0° C. The labeling arrangement (1) further comprises a base component (20) having a base layer (21) and an interlocking structure (22) comprising a plurality of hook-shaped coupling elements (23). The hook-shaped coupling elements (23) each comprise a first and a second portion (231, 232) which are geometrically different such that the first portion (231) extends laterally beyond the second portion (232) with respect to a main lateral extension plane of the base layer
(Continued)

Figure 1A:
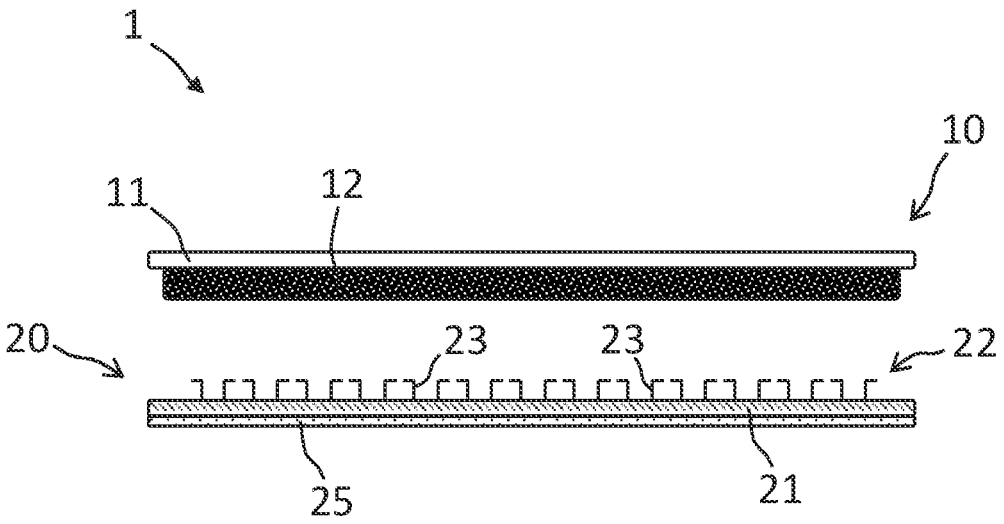

(21), the second portion (232) being arranged between the first portion (231) and the base layer (21) and coupling the first portion (231) to the base layer (21). The adhesive layer (12) is adapted to be coupled to the interlocking structure (22) above the freezing temperature of the adhesive layer (12) such that they form a positive coupling at freezer temperatures below the freezing temperature of the adhesive layer (12) and a substantial coupling at temperatures above the freezing temperature of the adhesive layer (12).

12 Claims, 6 Drawing Sheets

(56) References Cited

U.S. PATENT DOCUMENTS

| | | | | |
|---|---|---|---|---|
| 5,350,612 | A | 9/1994 | Stern et al. | |
| 5,417,790 | A * | 5/1995 | Petrou | G09F 3/10 40/594 |
| 5,584,580 | A * | 12/1996 | Vetter | B65D 33/20 383/93 |
| 5,641,318 | A * | 6/1997 | Vetter | B65D 27/16 493/213 |
| 5,715,215 | A * | 2/1998 | Haas | G04F 13/04 368/327 |
| 6,508,900 | B1 * | 1/2003 | Kendall | G09F 3/10 40/594 |
| 7,108,909 | B1 | 9/2006 | Perlman et al. | |
| 8,153,254 | B2 | 4/2012 | Arzt et al. | |
| 9,481,484 | B2 * | 11/2016 | Cho | G09F 3/04 |
| 10,297,171 | B2 | 5/2019 | Bent | |
| 2003/0141976 | A1 * | 7/2003 | Dickinson | B65D 33/004 40/299.01 |
| 2004/0035033 | A1 * | 2/2004 | Craig | G09F 21/048 40/591 |
| 2008/0178988 | A1 | 7/2008 | Ambartsoumian | |
| 2008/0250679 | A1 * | 10/2008 | McNamee | G09F 19/12 40/124 |
| 2010/0080951 | A1 | 4/2010 | Del Campo Becares et al. | |
| 2010/0299984 | A1 * | 12/2010 | Khieu | G09F 15/0018 40/607.13 |
| 2013/0067783 | A1 * | 3/2013 | Milne | G09F 7/18 40/594 |
| 2014/0000070 | A1 | 1/2014 | Ashraf et al. | |
| 2022/0036767 | A1 * | 2/2022 | Liebl | G09F 3/10 |

FOREIGN PATENT DOCUMENTS

| | | | |
|---|---|---|---|
| CN | 205158797 | U | 4/2016 |
| DE | 90 06 603 | U1 | 9/1990 |
| DE | 10 2014 119 470 | A1 | 6/2016 |
| EP | 0 048 157 | A1 | 3/1982 |
| EP | 0 393 953 | B1 | 10/1993 |
| EP | 1 041 901 | B1 | 7/2003 |
| EP | 1 196 056 | B1 | 11/2006 |
| EP | 1 513 904 | B1 | 1/2008 |
| EP | 1 601 263 | B1 | 7/2008 |
| EP | 1 944 267 | A1 | 7/2008 |
| EP | 2 094 123 | B1 | 8/2011 |
| EP | 2 799 224 | A1 | 11/2014 |
| JP | H10-273631 | A | 10/1998 |
| JP | H11-147544 | A | 6/1999 |
| JP | 2000-236919 | A | 9/2000 |
| JP | 2017056981 | A | 3/2017 |
| JP | 2017090777 | A | 5/2017 |
| WO | 2018/139520 | A1 | 8/2018 |

OTHER PUBLICATIONS

Chinese Examination Report in CN 201980081955.5, dated Jul. 21, 2022.

Chinese Notice of Allowance in CN 201980081955.5, dated Jan. 20, 2023.

* cited by examiner

LABELLING ARRANGEMENT FOR DEEP-FREEZE APPLICATIONS, SYSTEM AND METHOD FOR APPLYING A LABELLING ARRANGEMENT FOR DEEP-FREEZE APPLICATIONS

CROSS REFERENCE TO RELATED APPLICATIONS

This application is the National Stage of PCT/EP2019/084679 filed on Dec. 11, 2019, which claims priority under 35 U.S.C. § 119 of U.S. Provisional Patent Application Ser. No. 62/778,446 filed on Dec. 12, 2018, the disclosure of which is incorporated by reference. The international application under PCT article 21(2) was not published in English.

The present invention relates to a labeling arrangement for deep-freeze applications, a system and a method for applying a labeling arrangement for deep-freeze applications, each of which enables reliable labeling of a container at deep-freeze temperatures.

Labels offer a wide range of applications, particularly as a labeling medium. For example, labels are used to identify containers in order to provide information about their contents. A large number of products, especially in the pharmaceutical sector, are provided frozen and only labeled before the product is sent to its destination. Since adhesive properties of an adhesive are usually adversely affected at low temperatures, it is a challenge to provide reliable labeling for deep-freeze applications.

It is therefore an object of the invention to provide a labeling arrangement for deep-freeze applications, a system and a method for applying a labeling arrangement for deep-freeze applications, each of which enables reliable labeling of a container at deep-freeze temperatures in a simple and cost-effective manner.

The object is solved by the features of the independent patent claims. Advantageous embodiments are indicated in the respective dependent claims.

According to one aspect of the invention a labeling arrangement for deep-freeze applications, comprises a top label having a top layer and an adhesive layer disposed on a surface of the top layer and having a predetermined freezing temperature below 0° C. The labeling arrangement further comprises a base component having a base layer and an interlocking structure having a plurality of hook-shaped coupling elements disposed on a surface of the base layer. The hook-shaped coupling elements each have a first and a second portion that are geometrically different such that the first portion extends laterally beyond the second portion with respect to a main lateral plane of extension of the base layer. The second portion is disposed between the first portion and the base layer and couples the first portion to the base layer. The adhesive layer is adapted to be coupled to the interlocking structure above the freezing temperature of the adhesive layer, such that the top label and the base component form a positive coupling at freezer temperatures below the freezing temperature of the adhesive layer and a firmly bonded coupling at temperatures above the freezing temperature of the adhesive layer.

By means of the labeling arrangement described, reliable labeling of a container at deep-freezer temperatures is feasible in a simple and cost-effective manner, which can be manufactured in particular by machine or process automation.

The labeling arrangement enables a label to be permanently attached to a substrate of a deep-frozen product, such as a deep-frozen pharmaceutical agent, without the need for prior thawing or defrosting. In the context of the present description, freezer temperatures, deep-freeze applications and freezing ranges are used to refer to contexts with temperatures below 0° C. In particular, these may refer to common freezer temperatures of about −20° C. Preferably, however, a temperature range of −50° C. to −196° C. is also to be understood as a deep-freeze temperature range, which is set, for example, when cooling vials in order to keep corresponding contents reliably and stably cool. The deep-freeze temperature can be a temperature of an environment or the temperature of a container that has the deep-freeze temperature.

Particularly in the pharmaceutical sector, there are labeling specifications, for example set by a relevant drug regulatory authority, which require a permanent connection between a container and a label at deep-freeze temperatures. Some medicines are relatively cost-intensive to produce and store, so stock is usually kept low. These include active pharmaceutical ingredients that are produced biotechnologically and consist of large, sensitive molecules that must be stored at freezer temperatures.

Such medicines are usually first filled into a container, such as a vial or injection bottle, and stored frozen. If necessary, the containers are provided with a label that contains information in the language of the country of destination. For example, such a label is applied to the container shortly before transport.

One possibility is to thaw or defrost the containers beforehand so that an adhesive of a label can form a material bond with the adhesive base. However, such medicines or drugs are very temperature-sensitive, so thawing can have a detrimental effect on the contents of the container. Another costly option is to label a plastic cage at room temperature and then manually attach it to a vial.

By means of the present labeling arrangement, a cost-effective and reliable labeling of an object or container at low temperatures of about −70° C. is easily possible. Previously described products, such as pharmaceuticals to be stored frozen, do not need to be thawed and can be labeled at freezer temperatures by means of the labeling arrangement. In this way, the risk of product spoilage due to thawing or defrosting can be avoided. In particular, the labeling arrangement described can be applied with little effort and in an automated process.

For example, the base component with the interlocking structure can be applied or formed on the container at room temperature. The top label can then be labeled at low temperatures by coupling it with the interlocking structure. The top label has an adhesive layer that has the lowest possible freezing temperature, so that reliable and easy penetration of the interlocking structure into the adhesive is possible even at low temperatures. The hook-shaped coupling elements of the base component penetrate into the adhesive layer of the top label and bond with the top label, as the adhesive layer solidifies at the continuously low temperatures. Thus, by means of the adhesive layer and the coupling elements embedded therein, a form-fit is formed between the top label and the base component and the object or container remains bonded to the top label even at low temperatures. When the object thaws, the adhesive liquefies and forms a material bond with the base component.

According to a preferred embodiment, the base component is formed as a base label comprising an adhesive layer which is arranged on a surface of the base layer opposite the interlocking structure and which is configured to apply the base label to a container. The base layer is then, for example, a writable and/or printable top surface facing away from the container in an applied state.

Alternatively, the base component may be formed as a part of a container during its manufacture, for example by moulding. For example, the container has been formed as a plastic or glass vessel with the base component and the interlocking structure during an injection moulding process. According to such an embodiment, the base layer forms a part of the container wall on which the interlocking structure is formed.

The interlocking structure, with the hook-shaped coupling elements, has a shape that forms a retention force or resistance to easy detachment of the top label. This is made possible by the hook shape, which is realised in that an upper portion or the first portion extends laterally beyond the second portion. In other words, the second portion, which is arranged between the first portion and the base layer, is formed narrower than the first portion with respect to an extension transverse to a surface normal of the base layer. The described extension of the first portion in a lateral direction substantially parallel to a main extension plane of the base layer thus establishes the hook shape of the coupling elements. If the described labeling arrangement is attached to a cylindrical vial, for example, a radially acting retaining force is established with respect to a cylinder axis. Intentional detachment of the positively attached top label from the base component is therefore only possible with significantly increased force.

According to a further embodiment, a thickness of the adhesive layer of the top label in relation to a surface normal of the top layer is designed to match a geometry of the interlocking structure. In particular, the adhesive layer is designed to be comparatively thick so that complete penetration of the interlocking structure with the hook-shaped coupling elements into the adhesive layer is possible. With respect to a surface normal of the base layer, a height of the coupling elements is preferably formed smaller than the thickness of the adhesive layer. According to such an embodiment, the adhesive layer of the top label encloses the interlocking structure in a positively coupled state and contacts a surface of the base layer.

For example, the hook-shaped coupling elements have an upside-down L-shape with respect to a surface normal of the base layer. Alternatively, the respective first portions of the hook-shaped coupling elements have an arc shape and thus form a hook for the adhesive layer of the top label. The hook-shaped coupling elements may further be mushroom-shaped or frustoconical. Furthermore, the hook-shaped coupling elements can also have the shape of a diabolo with a flat head, a round head or a pointed head. The geometries always have in common that the first portion, which is formed further away from the base layer than the second portion, is wider than the second portion in relation to a lateral extent. In addition, a respective hook-shaped coupling element can also have a third portion or further portions with different shapes.

According to a particularly preferred embodiment, the adhesive layer comprises a solvent-based adhesive having a freezing temperature below −15° C. In particular, the adhesive layer may comprise an arcylate or natural adhesive which provides a freezing temperature below −15° C. For example, the adhesive layer is formed with an alcohol-based adhesive and has a freezing temperature point of −18° C. or lower. When coupled to the interlocking structure, the adhesive layer has a temperature above the freezing point so that the hook-shaped coupling elements can easily and reliably penetrate the adhesive layer. Preferably, therefore, an adhesive layer is provided comprising an adhesive in coordination with a frozen container to be labeled, that has a freezing temperature above an outer interface temperature of the frozen container. In this way, it is possible to form a secure and reliable positive coupling between the top label and the base label depending on the intended application to a deep-frozen container.

For example, a container is cooled by means of dry ice or liquid nitrogen and has a deep-freezer temperature of −50° C. to −76° C. when stored on dry ice or up to −196° C. when stored in liquid nitrogen with the base component attached or formed thereon, while the adhesive layer is prepared at a temperature of, e.g. 20° C. to 30° C., which is relatively warm. An ambient temperature during a coupling process of the top label can be 0° C. to −10° C. due to a relatively short cycle time of the coupling without critically increasing a temperature of the container due to the relatively low mass build-up of the adhesive layer. The relatively warm adhesive layer enables easy and low-effort pressing with the base component, so that, for example, a coupling period of half a second is given before the onset of shock freezing causes the adhesive layer to solidify. A heat transfer from the adhesive layer to the contents of the container is negligible due to the low mass set of the adhesive layer. In particular, the base component in the form of a base label insulates the container and its contents from the heat of the adhesive layer.

By means of the labeling arrangement, a simple and cost-effective construction of a deep-freeze label can be realised, which enables reliable labeling of a deep-frozen container. The frozen container does not have to be thawed or defrosted for this purpose, so that safe storage of the frozen contents in the container is also contributed to during labeling. The top label and the base component have a clear and inexpensive structure and enable machine or process-automated application to frozen containers.

Another aspect of the invention relates to a system comprising a container and an embodiment of the previously described labeling arrangement for frozen applications applied to the container such that the hook-shaped coupling elements of the interlocking structure extend into the adhesive layer and the top label is coupled to the base component. Thus, at freezing temperatures below the freezing temperature of the adhesive layer, a positive coupling is formed and at temperatures above the freezing temperature of the adhesive layer, a material coupling is formed between the top label and the base component.

The form-fit coupling of the adhesive layer and the interlocking structure at freezer temperatures of, for example, −50° C. to −80° C. or up to −196° C. realises a semi-permanent connection between the top label and the base component, which is replaced by a material-fit, adhesive coupling when the container is used and the contents are thawed. During such a thawing process, the form-fit is gradually reduced, while the material-fit gradually increases when the freezing temperature of the adhesive is exceeded. In this way, the labeling arrangement realises a permanent connection between the top label and the base component firmly attached to or formed on the container. Thus, a reliable and stable bond is provided at freezer temperatures and at room temperature.

Since the system comprises an applied embodiment of the previously described labeling arrangement, properties and features described in connection with the labeling arrangement are also disclosed for the system and vice versa.

Another aspect of the invention relates to a method for applying a labeling arrangement for frozen applications to a container. The method comprises providing a frozen container having a base component comprising a base layer and an interlocking structure comprising a plurality of hook-shaped coupling elements disposed on a surface of the base layer. The container and the base component attached thereto have a cryogenic temperature below −15° C. The method further comprises providing a top label having a top layer and an adhesive layer disposed on a surface of the top layer and having a predetermined freezing temperature below 0° C. The method further comprises coupling the top label to the base component by inserting the interlocking structure into the adhesive layer having a temperature above the freezing temperature of the adhesive layer. By dropping the temperature of the adhesive layer below its freezing temperature, a positive coupling is formed between the top label and the base component and the labeling arrangement is applied to the deep-frozen container in a positive-locking manner.

In particular, the described method implements an application method for applying an embodiment of the previously described labeling arrangement, so that properties and features described in connection with the labeling arrangement are also disclosed for the method, and vice versa.

According to an embodiment of the method, coupling the top label to the base component by means of introducing the interlocking structure into the adhesive layer comprises heating the adhesive layer by means of a heating element and introducing the interlocking structure into the heated adhesive layer. In this way, the adhesive layer can be easily and reliably lubricated around the interlocking structure to form a secure and stable form-fit. The heating element can be designed, for example, as a heatable dispensing edge that passes the adhesive layer before the coupling process. The adhesive or the adhesive layer can thus be made "more pliable" and form a particularly reliable form-fit with the interlocking structure.

In addition, the top label is preferably coated comparatively thickly with adhesive to allow, among other things, complete enclosure of the interlocking structure. Furthermore, a freezing point or temperature of the adhesive layer is preferably selected as low as possible to give the adhesive layer some time (fraction of seconds) to nestle around the hook-shaped coupling elements before freezing.

According to a preferred embodiment of the method, providing a frozen container with a base component comprises providing the base component as a base label with an adhesive layer disposed on a surface of the base layer opposite the interlocking structure. The method further comprises attaching the base component to a surface of the container by means of the adhesive layer of the base component, and freezing the container with the attached base component to a freezer temperature below −15° C.

Before the container is filled with, for example, a temperature-sensitive medicament, the container to be adhered is provided with a base label which has the interlocking structure and which is adhered, for example at room temperature, to an outer surface of the container. Such dispensing of the base label can be carried out, in particular, automatically. Subsequently, the container with the glued base label is deep-frozen and filled with a predetermined temperature-sensitive content.

A configuration of the base component in the form of a base label also makes it possible to print or label information about a medicinal product to be filled in order to enable a secure and reliable identification of the product, for example within a product chain of a pharmaceutical manufacturer. In this way, additional indicators customary in the market, such as coloured ring representations or the like, can be dispensed with.

Alternatively, providing a frozen container with the base component may comprise moulding the container so that the base component is formed with the interlocking structure. This may be followed by freezing the container including the base component to a freezer temperature below −15° C. In this way, the formation of the base component can be taken into account by a container manufacturer, for example by producing the container by injection moulding and having an interlocking structure in a predetermined area. Such a container would thus be ready for deep-freeze labeling according to the described labeling arrangement.

According to a further embodiment, the method comprises thawing the deep-frozen container and the labeling arrangement applied thereto by means of heating, so that by exceeding the temperature of the adhesive layer above the freezing temperature, a material-locking coupling is formed between the top label and the base component and the labeling arrangement is applied to the container in a material-locking manner.

The form-fit coupling between the top label and the base component is formed at or for freezer temperatures, so that a reliable connection of the top label to the container is established even at temperatures below −20° C., −50° C., −76° C. or −196° C. of the container. Thawing is usually carried out when the contents of the container are intended to be used and can be carried out at a much later stage. For example, the container with the applied labeling arrangement is stored at a temperature of −70° C. for months and sent to its destination on demand Upon thawing, the viscosity of the frozen adhesive layer gradually decreases to a range suitable for adhesive bonding and the positive coupling between the top label and the base component changes to a material coupling.

Figure 1B:
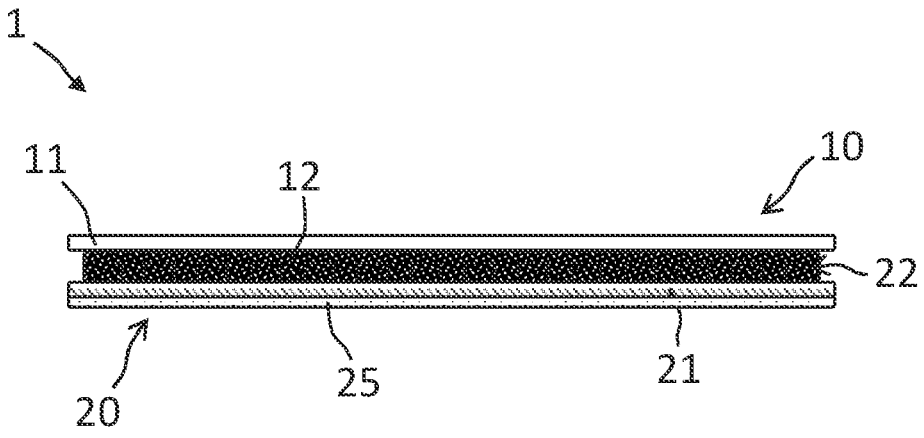
Figure 1C:
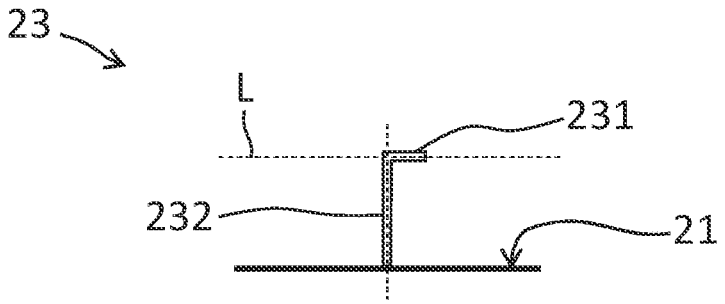
Figure 1D:
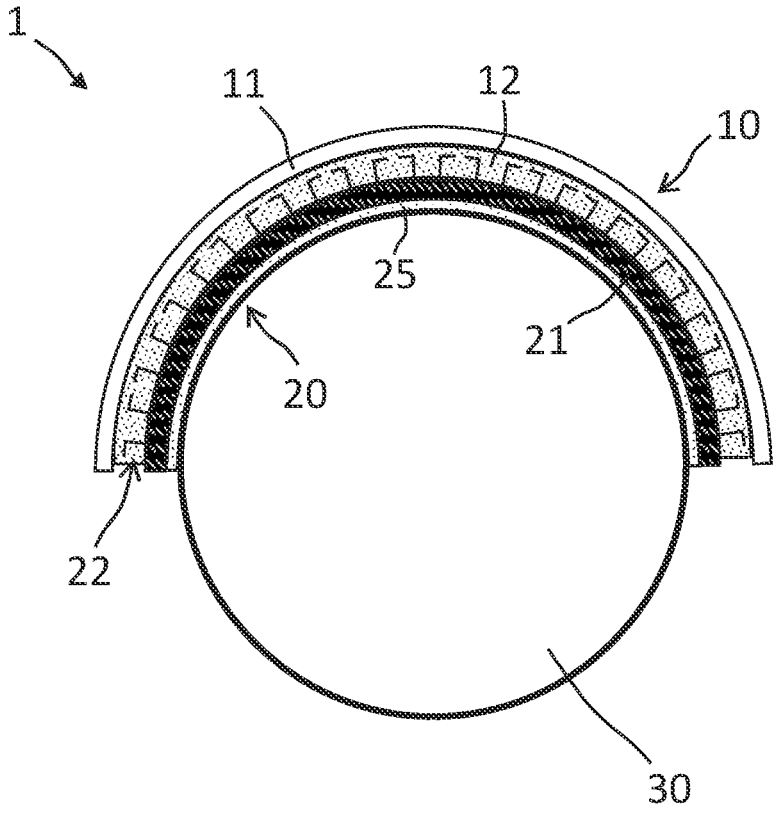
Figure 1E:
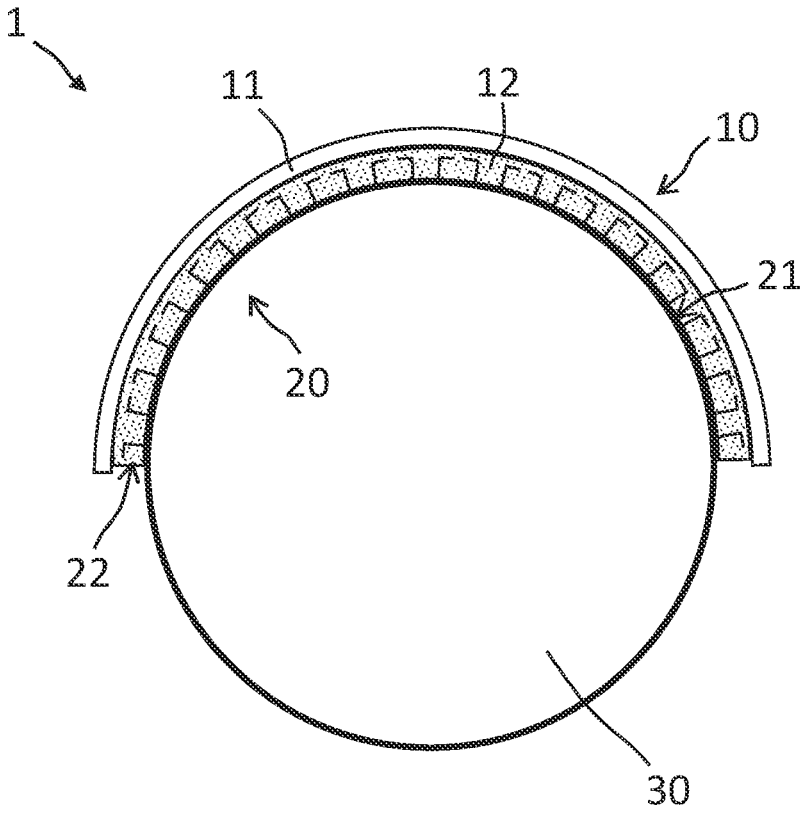
Figure 2A:
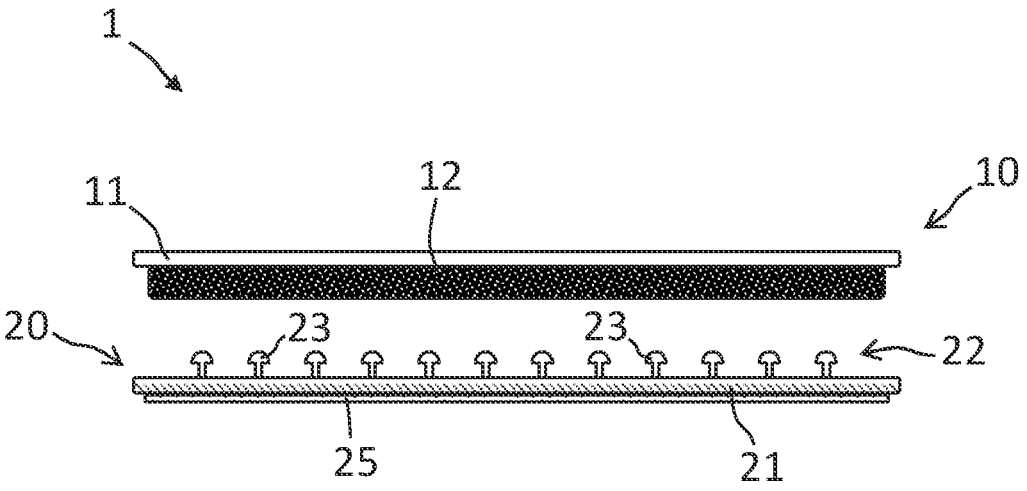
Figure 2B:
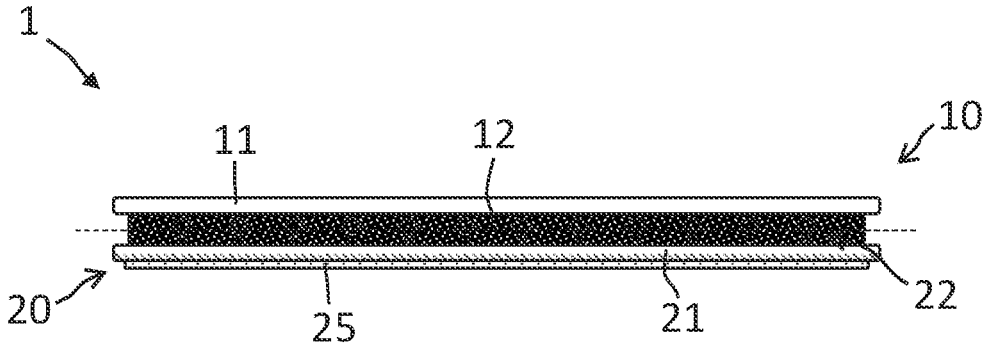
Figure 2C:
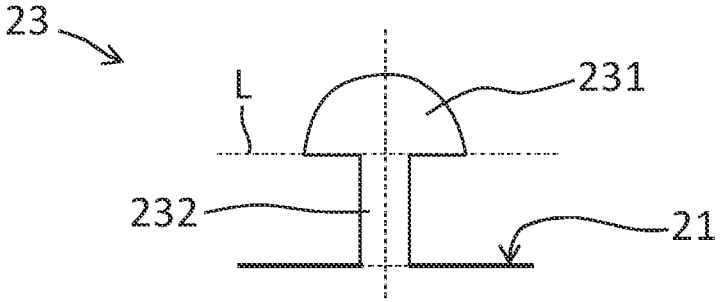
Figure 3A:
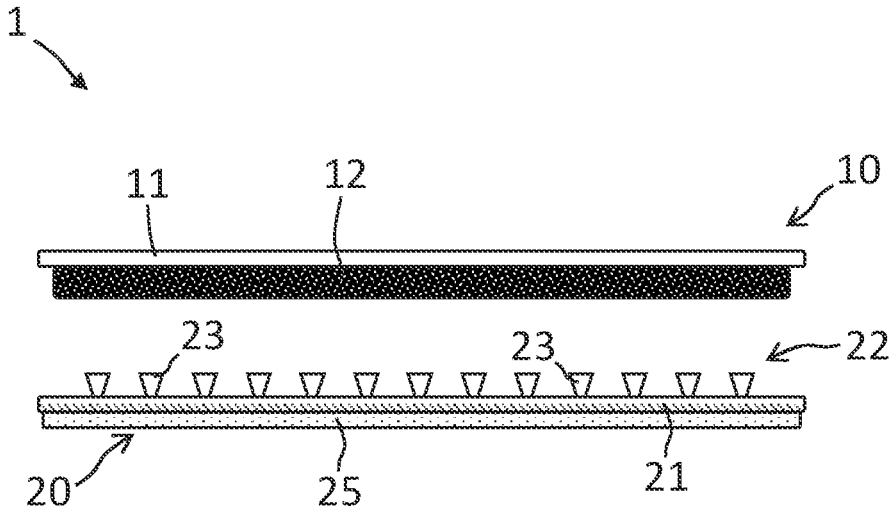
Figure 3B:
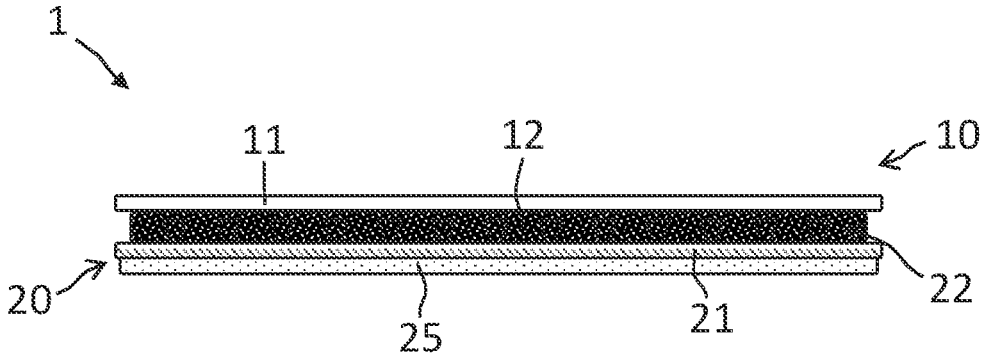
Figure 4:
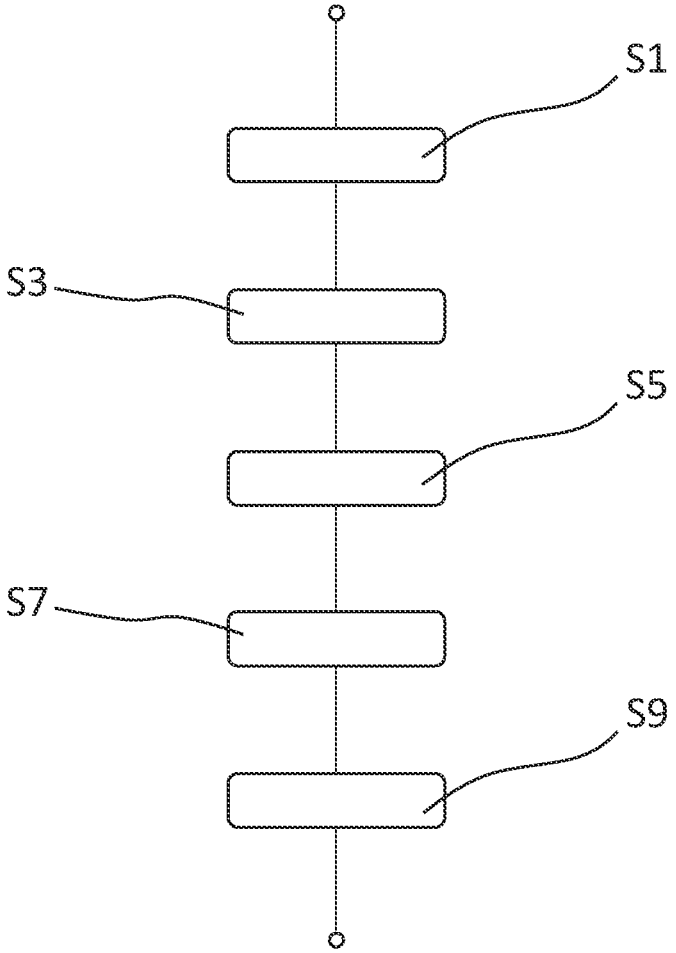

Embodiments of the invention are explained in more detail below with reference to schematic drawings. They show:

FIGS. 1A-1D an embodiment of a labeling arrangement for deep-freeze applications, FIG. 1E a further embodiment of the labeling arrangement for deep-freeze applications, FIGS. 2A-2C a further embodiment of the labeling arrangement for deep-freeze applications, FIGS. 3A-3B a further embodiment of the labeling arrangement for deep-freeze applications, FIG. 4 a schematic flow chart for a method of applying a labeling arrangement for deep-freeze applications.

Elements of the same or equivalent design or function are marked with the same reference signs across the figures. For reasons of clarity, not all of the elements shown in all of the figures are identified with the corresponding reference signs.

FIGS. 1A to 1D each schematically illustrate an embodiment of a labeling arrangement 1 for a freezer label. FIG. 1A shows a schematic side view of the labeling arrangement 1, which has a top label 10 with an adhesive layer 12, which is arranged on an underside of a top layer 11 and which has a predetermined freezing temperature below 0° C.

The labeling arrangement 1 further comprises a base component 20 in the form of a base label having a base layer 21 and an interlocking structure 22 comprising a plurality of hook-shaped coupling elements 23. An adhesive layer 25 is provided on an underside of the base layer 21 or a side of the base layer 21 facing away from the interlocking structure 22, for attaching the base label to a container 30 in a simple and reliable manner. The hook-shaped coupling elements 23 each comprise a first and a second portion 231, 232 which are geometrically different, such that the first portion 231 extends laterally beyond the second portion 232 with respect to a main lateral extension plane of the base layer 21 (see FIGS. 1C and 2C). The second portion 232 is disposed between the first portion 231 and the base layer 21, and couples the first portion 231 to the base layer 21.

The adhesive layer 12 is adapted to be coupled to the interlocking structure 22 above its freezing temperature so that they form a positive coupling at freezer temperatures below its freezing temperature and a substantial coupling at temperatures above its freezing temperature.

FIG. 1A shows the labeling arrangement 1, which provides a simple and inexpensive two-component solution for a deep-freeze label that enables a deep-freeze container 30 to be labeled reliably and with little effort. FIG. 1B shows the labeling arrangement 1 according to FIG. 1A in a coupled state, in which the interlocking structure 22 extends into the adhesive layer 12 and is enclosed by it. Such a coupling is, for example, the positive connection of the top label 10 and the base label 20 formed at freezer temperatures. In this context, freezer temperatures refer to temperatures, in particular of the container 30, below −20° C., for example of about −50° C., −70° C. or −80° C. but at least below 0° C.

FIG. 1C shows a schematic representation of an embodiment of a hook-shaped coupling element 23. With respect to a lateral extension direction L of the base layer 21, the first portion 231 projects beyond the second portion 232 and forms a hook-shaped geometry. In this way, the interlocking structure 22 with the hook-shaped coupling elements 23 provides a retaining force that realises a resistance to easy detachment of the top label 10 from the base label 20. The second portion 232 is disposed between the first portion 231 and the base layer 21, and is formed narrower than the first portion 231 with respect to the lateral extension direction L.

The labeling arrangement 1 may be formed in a single layer with respect to the top label 10 and/or the base component 20, so that apart from an adhesive layer 12 of the top label 10 and the adhesive layer 25 of the base label 20, it comprises only a top layer 11 and/or base layer 21. Alternatively, the labeling arrangement 1 can also have a multi-layer design with respect to the top label 10 and/or the base component 20, so that, for example, the top label 10 has one or more further layers in addition to the top layer 11, which comprise, for example, a void structure, die-cuts and/or predetermined perforation structures and contribute to increased protection against manipulation.

FIG. 1D shows a schematic view of the labeling arrangement 1 according to FIGS. 1A-1C applied to the container 30, which is for example a cylindrical vial, an injection bottle or a vial. With respect to a cylinder axis, the interlocking structure 22 with the hook-shaped coupling elements 23 thus establishes a radially acting retention force. Intentional detachment of the positively attached top label 10 from the base component 20 is therefore only possible with significantly increased force. The base label 20 has been attached to the container 30 at room temperature, for example, and is secured to an outer surface of the container 30 by means of the adhesive layer 25.

Subsequently, the container 30 has been frozen and filled with a temperature-sensitive content, such as a pharmaceutical product or medication. The top label 10 has then been coupled to the base component 20 to form a reliable and stable form fit to the container 30 without having to thaw or defrost it. If the product is to be used in the container 30 and is therefore to be thawed, the temperature of the frozen adhesive layer 12 rises so that the adhesive layer 12 liquefies again above its freezing temperature and forms a material bond between the top label 10 and the base label 20. Thus, even when labeling at freezer temperatures, the labeling arrangement 1 provides reliable and secure labeling of the container 30.

The labeling arrangement 1 can cover an outer part of the surface of the container 30, as illustrated in FIG. 1D, or alternatively form a wrap-around label. In addition, the labeling arrangement 1 may also provide an over-round wrap-around label, which has a predetermined length in accordance with a circumference of the container 30, so that at least part of the labeling arrangement 1 comes to rest on itself after wrapping around the container 30. According to such an embodiment of the labeling arrangement 1, it is also possible that an interlocking structure 22 is provided only in the overlapping region, which interlocks with the adhesive layer 12 of the top label 10 at deep-freezing temperatures. In particular, with such an embodiment of the labeling arrangement 1, a separate base component 20 can be avoided or, in other words, a portion of the top label 10 co-forms the base component 20. The top label 10 can then be attached to an outer surface of the container 30 by means of the adhesive layer 12, for example, and coupled in the overlap region to the interlocking structure 22, which is attached in the overlap region to a top surface of the top label 10 that would face away from the container 30. Starting from a container centre, such a layered structure in the overlap region would be configured as follows: container 30 or container wall, adhesive layer 12, top layer 11, interlocking structure 22 and adhesive layer 12, top layer 11.

FIG. 1E shows a schematic view of a further embodiment of an applied labeling arrangement 1. The base component 20 is formed as a part of a container wall, so that the base layer 21 represents a section of the container wall. The base component 20 with the interlocking structure 22 has been formed, for example, by casting directly with the container 30. For example, the container 30 is formed as a plastic or glass vessel and with the interlocking structure 22 is ready for freezer labeling according to the described labeling arrangement 1.

FIGS. 2A to 2C show schematic views of a further embodiment of the labeling arrangement 1, which has mushroom-shaped coupling elements 23. Such a mushroom shape also enables hooking or catching in the adhesive layer 12 of the top label 10, and thus a stable and secure form-fit when labeling at freezer temperatures of the container 30, with the mushroom head representing the first portion 231 and the narrower stem representing the second portion 232.

The adhesive layer 12 and the interlocking structure 22 are preferably formed in coordination with each other such that the hook-shaped coupling elements 23 can fully penetrate into and be enclosed by the adhesive layer 12. Furthermore, a freezing point or a freezing temperature of the adhesive layer 12 is preferably selected as low as possible in order to give the adhesive layer 12 a certain time to nestle around the hook-shaped coupling elements 23 during a coupling process with the interlocking structure 22 before the adhesive layer 12 freezes and the positive coupling is formed. In addition, suitable measures, such as heating the adhesive layer 12 by means of a heatable dispensing edge, may increase an initial temperature of the adhesive layer 12 to provide more time for forming a reliable coupling between the top label 10 and the base component 20 until the adhesive layer 12 freezes.

FIGS. 3A and 3B show schematic views of another embodiment of the labeling arrangement 1, which has frustoconical coupling elements 23. Such a geometry of the coupling elements 23 also provides a form-fit based retention force against detachment of the top label 10 from the base label 20.

FIG. 4 shows a schematic flow chart for a method of applying the labeling arrangement 1. In a first step S1, the deep-frozen container 30 is provided with the base component 20 attached to or formed on it. In this process, the base component 20 can be adhered to an outer side of the container 30 in the form of a base label at room temperature. This application can in particular be automated.

Alternatively, the base component 20 is formed directly during the manufacture of the container 30 and forms part of the container wall. Before a temperature-sensitive content, such as a medicament, is filled into the container 30, the container 30 is provided with the base component 20 and is deep-frozen.

In a further step S3, the top label 10 is provided with a comparatively thick adhesive layer 12.

In a further step S5, the coupling of the top label 10 with the base component 20 and thus an attachment of the top label 10 to the deep-frozen container 30 is carried out. The top label 10 is labeled at low temperatures. Preferably, the adhesive layer 12 of the top label 10 has a freezing point as low as possible. For example, the temperature of the deep-frozen container 30 is about −70° C., the ambient temperature is about −5° C. and the temperature of the adhesive layer 12 is, for example, 20° C. to 60° C. For example, the adhesive layer 12 comprises a solvent-based adhesive having a freezing temperature below −18° C. Optionally but preferably, the adhesive layer 12 is heated by means of a heatable dispensing edge and then brought into contact with the interlocking structure 22.

The adhesive layer 12 is formed around the geometric structure of the hook-shaped coupling elements 23 by the application of force during dispensing. As a result of the container 30 and the base component 20 connected thereto being at a significantly lower temperature than the adhesive layer 12, the latter is shock-frozen and forms a positive connection with the interlocking structure 22. The hooked coupling elements 23 of the base component 20 penetrate and bond with the adhesive layer 12 of the top label 10 as the adhesive layer 12 solidifies. Thus, the container 30 remains bonded to the top label 10 at low temperatures and thawing of the container 30 to attach the top label 10 can be avoided. In this way, the contents in the container 30 can always be kept frozen and still be reliably and inexpensively labeled by means of the labeling arrangement 1. Thereupon, the labeled and deep-frozen container 30 can be stored and kept deep-frozen until it is used.

In a further S7, the container 30 is then thawed for use of the contents therein. When the labeled container 30 is thawed and the adhesive layer 12 is warmed above the dew point or its freezing point, the adhesive layer 12 liquefies and forms a material bond with the base component 20, so that there is always a reliable and secure bond between the top label 10 and the container 30.

By means of the described labeling arrangement 1 and the application method, reliable labeling of the container 30 at deep-freeze temperatures can be realised in a simple and cost-effective manner, which can be carried out in particular by machine or process automation and which contributes to keeping the temperature entry into a temperature-sensitive content in the container 30 low.

REFERENCE SIGNS

1 labeling arrangement
10 top label
11 top layer
12 adhesive layer of the top layer
20 base component
21 base layer
22 interlocking structure
23 hook-shaped coupling element
231 first portion of the coupling elements
232 second portion of the coupling elements
25 adhesive layer of the base layer
L lateral direction of extension
S(i) steps of a method for applying a labeling assembly for deep-frozen applications

The invention claimed is:

1. A labelling arrangement (1) for deep-freeze applications, comprising:

a top label (10) having a top layer (11) and an adhesive layer (12) disposed on a surface of the top layer (11) and having a predetermined freezing temperature below 0° C., and a base component (20) comprising a base layer (21) and an interlocking structure (22) having a plurality of hook-shaped coupling elements (23) disposed on a surface of the base layer (21), wherein the hook-shaped coupling elements (23) each comprise a first portion (231) and a second portion (232) that are geometrically different such that the first portion (231) extends laterally beyond the second portion (232) with respect to a main lateral plane of extension of the base layer (21), and wherein the second portion (232) is disposed between the first portion (231) and the base layer (21) and couples the first portion (231) to the base layer (21), and wherein the adhesive layer (12) is configured to be coupled to the interlocking structure (22) above the freezing temperature of the adhesive layer (12) such that the top label (10) and the base component (20) form a positive coupling at freezer temperatures below the freezing temperature of the adhesive layer (12) and a substantial coupling at temperatures above the freezing temperature of the adhesive layer (12).

2. The labelling arrangement (1) according to claim 1, wherein the base component (20) is formed as a base label (20) comprising an adhesive layer (25) which is arranged on a surface of the base layer (21) opposite the interlocking structure (22) and which is adapted to apply the base label (20) to a container (30).

3. The labelling arrangement (1) according to claim 1, wherein the base component (20) is co-formed as a part of a container (30) when the container (30) is manufactured.

4. The labelling arrangement (1) according to claim 1, wherein a thickness of the adhesive layer (12) of the top label (10) is formed to match a geometry of the interlocking structure (22) with respect to a surface normal of the top layer (11).

5. The labelling arrangement (1) according to claim 1, in which the respective hook-shaped coupling elements (23) are mushroom-shaped or frustoconical.

6. The labelling arrangement (1) according to claim 1, wherein the adhesive layer (12) of the top label (10) comprises an adhesive having a freezing temperature in coordination with a frozen container (30) above an outer interface temperature of the frozen container (30) to be labelled with the labelling assembly (1).

7. A system comprising:

a container (30), and the labelling arrangement (1) for frozen applications according to claim 1 applied to the container (30), such that the hook-shaped coupling elements (23) of the interlocking structure (22) extend into the adhesive layer (12) of the top label (10) and couple the top label (10) to the base component (20) and form a form-fit at freezer temperatures below the freezing temperature of the adhesive layer (12) of the top label (10) and a material-fit at temperatures above the freezing temperature of the adhesive layer (12) of the top label (10).

8. A method for applying a labelling arrangement (1) for frozen applications to a container (30), comprising:

providing a frozen container (30) having a base component (20) coupled to the container (30), the base component (20) having a base layer (21) and an interlocking structure (22) having a plurality of hook-shaped coupling elements (23) disposed on a surface of the base layer (21), wherein the container (30) has a freezer temperature below −15° C., providing a top label (10) comprising a top layer (11) and an adhesive layer (12) disposed on a surface of the top layer (11) and having a predetermined freezing temperature below 0° C., coupling the top label (10) to the base component (20) by means of inserting the interlocking structure (22) into the adhesive layer (12), which has a temperature above the freezing temperature of the adhesive layer (12), so that a positive coupling is formed between the top label (10) and the base component (20) by the temperature of the adhesive layer (12) falling below the freezing temperature and thereby applying the labelling arrangement (1) to the container (30).

9. The method of claim 8, wherein coupling the top label (10) to the base component (20) by means of inserting the interlocking structure (22) into the adhesive layer (12) comprises:

heating the adhesive layer (12) by means of a heating element and inserting the interlocking structure (22) into the heated adhesive layer (12).

10. The method according to claim 8, wherein providing a frozen container (30) with a base component (20) comprises:

providing the base component (20) as a base label (20) having an adhesive layer (25) disposed on a surface of the base layer (21) opposite the interlocking structure (22), attaching the base component (20) to a surface of the container (30) by means of the adhesive layer (25) of the base component (20), and freezing the container (30) with the base component (20) attached thereto to a freezer temperature below −15° C.

11. The method of claim 8, wherein providing a frozen container (30) with a base component (20) comprises:

making the container (30) and thereby forming the base component (20) with the interlocking structure (22), and freezing the container (30) with the base component (20) to a freezer temperature below −15° C.

12. The method according to claim 8, comprising:

thawing the deep-frozen container (30) and the labelling arrangement (1) applied thereto by means of heating, so that by exceeding the temperature of the adhesive layer (12) of the top label (10) above its freezing temperature a material coupling is formed between the top label (10) and the base component (20) and the labelling arrangement (1) is applied to the container (30).

* * * * *